United States Patent [19]

Kettlestrings

[11] 4,353,166

[45] Oct. 12, 1982

[54] TOY-LIKE INSTRUMENT FOR DRAWING CIRCLES

[76] Inventor: John S. Kettlestrings, 907 N. President St., Wheaton, Ill. 60187

[21] Appl. No.: 200,397

[22] Filed: Oct. 24, 1980

[51] Int. Cl.[3] ..... B43L 9/04

[52] U.S. Cl. ..... 33/27 C

[58] Field of Search ..... 33/174 B, 1 B, 27 C, 33/26, 403

[56] References Cited

U.S. PATENT DOCUMENTS

| | | | |
|---|---|---|---|
| 1,154,673 | 9/1915 | Van Ness | 33/27 C X |
| 1,307,233 | 6/1919 | Bernard | 33/27 C |
| 2,190,071 | 2/1940 | Keppers | 33/403 |
| 2,624,117 | 1/1953 | Paci | 33/27 C |
| 3,460,261 | 8/1969 | Frey | 33/27 C |
| 4,129,948 | 12/1978 | Hatter et al. | 33/27 C |
| 4,158,257 | 6/1979 | Kupperman et al. | 33/25 R |

*Primary Examiner*—Harry N. Haroian

*Attorney, Agent, or Firm*—Hill, Van Santen, Steadman, Chiara & Simpson

[57] ABSTRACT

A device for drawing circles is provided which is compact in form and has no sharp points. The device is comprised of a disk rotatably carried on a sheet adjacent and concentric to a hole in the sheet. The disk and sheet each have a series of holes therein spaced from a center point of the disk into which the tip of suitable writing instrument may be placed to rotate the disk or sheet with respect to the other, thus inscribing a circle on a desired surface.

6 Claims, 5 Drawing Figures

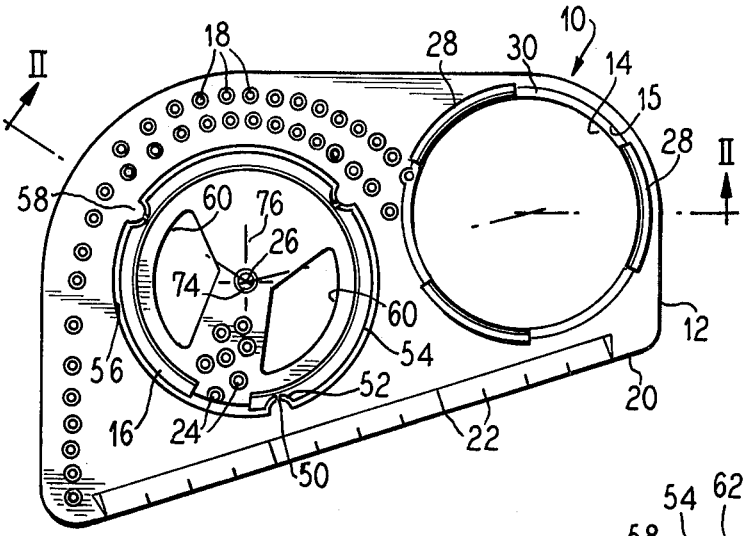
Fig. 1
Fig. 3
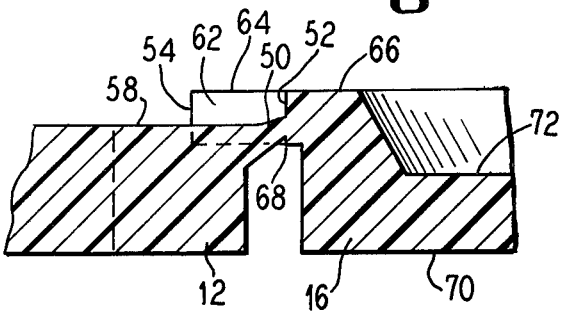
Fig. 2
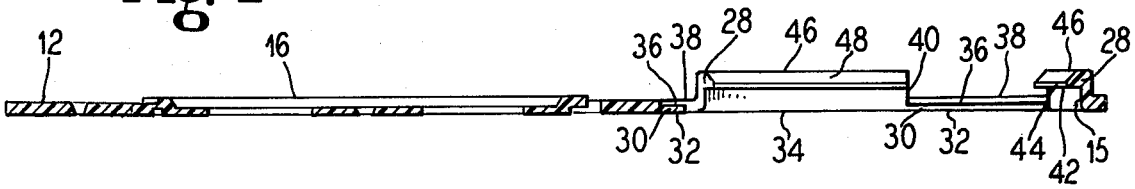
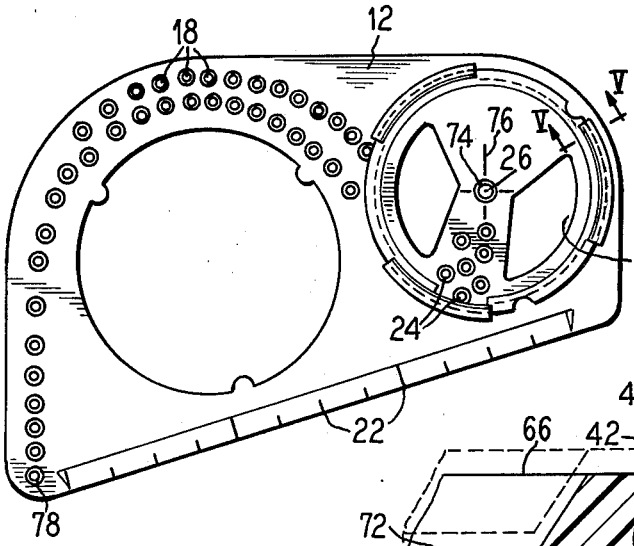
Fig. 4
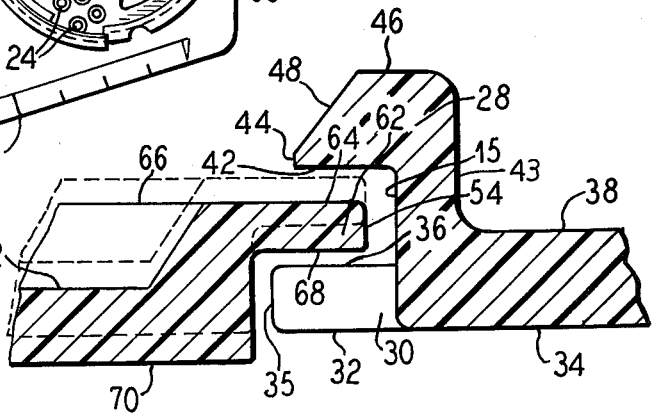
Fig. 5

TOY-LIKE INSTRUMENT FOR DRAWING CIRCLES

BACKGROUND OF THE INVENTION

1. Field of the Invention

This invention relates to an apparatus for drawing circles.

2. Description of the Prior Art

The prior art provides several different types of devices for drawing circles. Most of these devices require a sharp and usually metal point such as a compass tip to act as a pivot to which a pivot arm is connected having a means for marking, such as a pencil lead attached to an opposite end of the pivot arm for inscribing a circle. Devices which employ a sharp pointed member may be unsuitable for use by children due to their inherent dangerousness.

Additionally, the sharp point defaces the paper or other surface on which the circle is being inscribed by putting a small hole in the surface.

There are other devices in the prior art for drawing circles which do not incorporate any sharp points which are usually sheets of plastic material having various sized holes therein which are aligned concentrically with the point about which the circle is to be drawn and the pencil or other writing instrument is abutted against the circumferential wall of the hole and is guided along that wall so as to inscribe a circle on the surface under the plastic sheet. This type of device requires a sheet which is greater in diameter than the circle which is to be drawn, and additionally, if several holes are incorporated in the same sheet, the size of the sheet increases by greater than the diameter of each additional hole.

SUMMARY OF THE INVENTION

The present invention provides for a device for drawing circles which has no sharp points which could be injurious to the user. Additionally, the device is compact in that it can be used to inscribe a circle having a diameter greater than the length of the device.

In accordance with the principles of the invention, a sheet of transparent plastic or other suitable material is provided with a circular hole near one end. A circular member or disk having a circumferential lip with a diameter slightly greater than the hole is retained in a floating rotatable manner adjacent the sheet and concentric with the hole so that it is rotatable with respect to the hole.

A series of small holes sized to receive pencil leads or other suitable writing instruments are spaced from the center point of the disk to the far end of the sheet at given constant intervals. The face of the disk may contain indicia to aid in locating the center point of the disk which is to be placed directly above the center point of the circle to be drawn.

To draw relatively large circles, the disk is held against the surface on which the circle is to be drawn and a pencil or other suitable writing instrument is placed in the hole representing the desired radius of the circle. The sheet is then rotated about the fixed disk while the writing instrument is held against the surface below the disk thereby inscribing a circle of the desired diameter. To draw circles having a radius smaller than the radius of the disk, a pencil or other suitable writing instrument is placed in a hole in the disk representing the desired radius of the circle to be drawn. The sheet is held stationary and the floating disk is rotated within the sheet thereby inscribing a circle of the desired size.

Additionally, the sheet may contain a straight edge which may also have indicia thereon for use in measuring distances and can be used in conjunction with determining the proper hole to be used in inscribing a circle of the desired size.

DESCRIPTION OF THE DRAWINGS

FIG. 1 is a top elevational view of the device embodying the present invention.

FIG. 2 is a sectional view of the device shown in FIG. 1 taken generally along the lines II—II of FIG. 1.

FIG. 3 is a detailed partial sectional view of the gate area of the device shown in FIG. 1.

FIG. 4 is a top elevational view of the device shown in FIG. 1 in an assembled position.

FIG. 5 is a partial sectional view taken generally along the lines V—V of FIG. 4.

DESCRIPTION OF THE PREFERRED EMBODIMENTS

A device 10 for drawing circles is shown generally in FIG. 1 as being comprised of a generally flat elongated plate or sheet 12 approximately 9 cm long having a hole 14 with a circumferential wall 15 formed at one end thereof. The sheet or plate 12 may also carry a removable circular member or disk 16. The plate or sheet 12 contains a series of small holes 18 and has one linear edge 20 which contains measurement indicia 22. The circular disk 16 also contains a series of holes 24 spaced at a specific given interval from a center point 26 of the disk 16.

The circumference of the hole 14 in the plate or sheet 12 is characterized by alternating upper lips 28 and lower lips 30. As seen in FIG. 2, the lower lip 30 has a bottom wall 32 which is coplanar with the bottom surface 34 of the sheet 12. A top surface 36 of the lower lip 30 is formed at an elevation below a top surface 38 of the sheet 12. The lip 30 projects radially inward from the circumferential wall 15 of the hole 14 and terminates in an inner circumferential wall 35.

The lower lips 30 and the upper lips 28 are alternating as also seen in FIG. 2. That is, the lips are formed in arcs around the circumference of the hole 14 such that adjacent lips terminate at a common point such as at 40. This alternating construction of the lips allows the sheet 12 and the lips 28, 30 to be molded of a plastic material in a one-step straight draw process.

The upper lip 28 has a lower surface 42 which is elevated above the top surface 38 of the sheet 12. The upper lip 28 is carried above the top surface 38 by means of a resilient support 43. The lip 28 projects radially inward from the circumferential wall 15 of the hole 14 and terminates in an inner circumferential wall 44. A top surface 46 of the upper lip 28 has a sloping portion 48 which slopes downwardly and radially inwardly to terminate at the inner circumferential wall 44.

As seen in FIG. 1, the circular member or disk 16 can be formed as an integral part of the sheet or plate 12 during the molding process. The disk 16 is essentially a separate piece from the sheet 12, however it can be molded at the same time and integral with the sheet 12 by means of a gated area 50 formed by a gate in the mold. The gated area 50 is best seen in FIG. 3.

A semi-circular recess 52 is formed in an outer circumferential wall 54 of the disk 16. Three of such semi-circular recesses 52 are shown in FIG. 1, however this number is not fixed and any number may be used. The disk 16 is carried within a hole 56 which has a diameter slightly greater than the disk 16 to provide for clearance around the circumferential wall 54 of the disk 16. The hole 56 has semi-circular ears 58 projecting thereinto corresponding to the semi-circular recesses 52 in the disk and which define the locations of the gated areas 50. The disk 16 can have formed therein holes such as at 60 to provide for a lighter disk and to conserve materials used in the manufacture of the disk.

The circular member of disk 16 has a flange 62 formed at the outer circumferential wall 54 of the disk as best seen in FIGS. 3 and 5. The flange 62 has a top surface 64 which is coplanar with the top of the disk 66 and has a bottom surface 68 which is at an elevation above the bottom 70 of the disk. Additionally, the center portion 72 of the disk 16 is of a thickness less than that of the entire disk, again to provide for a lighter disk and to conserve materials.

Thus, as is seen in FIG. 2, the entire assembly of the sheet 12 and the disk 16 comprises a generally flat and elongated shape. The upper lips 28 and the flange 62 are the only portions which project above the upper surface 38 of the sheet 12, resulting in a compact device.

The device 10 is operated as follows: The disk 16 is removed from the sheet 12 by applying pressure adjacent the semi-circular recesses 52 in the disk and thereby breaking the connection between the disk 16 and the sheet 12 at the gated areas 50. The material associated with the gated areas 50 may separate anywhere between the disk 16 and the sheet 12 and thus the semi-circular cutouts 52 are provided so that there is nothing projecting beyond the outer circumferential wall 54 of the disk 16. The diameter of the outer circumferential wall 54 of the disk 16 is slightly greater than the inner circumferential wall 44 of the upper lips 28 and the inner circumferential wall 39 of the lower lips, however it is less than the diameter of the circumferential wall 15 of the hole 14. The support 43 for the upper lip is flexible and resilient allowing the lip to be urged radially outwardly when a force is placed thereon.

The disk 16 is placed over the hole 14 such that the flange 62 is placed under one of the upper lips 28 allowing the bottom surface 68 of the flange 62 to rest on the sloping portion 48 of the top surface 46 of the other upper lips 28. A downward force is applied on the disk 16 causing the upper lips to be urged radially outwardly thereby allowing the flange 62 to be retained between the upper lips 28 and the lower lips 30. Since the flange 62 is essentially continuous around the circumference of the disk, interrupted only by the semi-circular recesses 52, the flange is captured on top and bottom alternatively by the upper lips 28 and lower lips 30.

The thickness of the flange 62 of the disk 16 is less than the distance between the lower surface 42 of the upper lip 28 and the top surface 36 of the lower lip 30 such that the disk will be able to move up and down, that is float, between the alternating lips. As seen in the phantom line representation in FIG. 5, when the bottom of the disk 70 is coplanar with the bottom surface 34 of the sheet, the top 64 of the flange will be below the lower surface 42 of the upper lip 28 and the bottom surface 68 of the flange 62 will be above the top surface 36 of the lower lip 30 such that the disk will be free to rotate with respect to the sheet 12 within the confines described by the lips. Also, as seen in the solid line representation, the bottom 70 of the disk may be positioned below the bottom surface 34 of the sheet without causing the two pieces to bind during rotation between the two pieces.

The circular member or disk 16 acts as a pivot and the sheet or plate 12 acts as a pivot arm or link which is rotatable with respect to the circular member or disk 16. The holes 18 function as means associated with the pivot arm or link or plate 12 to retain a marking point such as a pencil point or other suitable writing instrument, a fixed distance from the pivot or disk 16.

A circle having a radius greater than the radius of the disk 16 is drawn by placing the device 10 over the center point of the circle to be drawn by lining up a hole 74 at the center point 26 of the disk 16 with the new center point or by aligning the center point indicia 76 with the new center point. The disk 16 is then held down against the surface upon which the circle is to be drawn and the sheet 12 is rotated or pivoted about the stationary disk 16 until a preselected radius point is visible beneath one of the holes 18 provided in the sheet 12. The holes 18 are spaced from the center point 26 of the disk 16 at given specific intervals.

When the proper one of the holes 18 is selected, a pencil point or other suitable writing instrument is inserted into that hole 18 so that it will contact the surface below the sheet 12 on which the circle is to be drawn. With the disk 16 firmly held in place, the sheet 12 is then rotated or pivoted about the disk 16 by moving the pencil or other writing instrument thereby inscribing a circle on the surface below the sheet 12. In this manner, a circle having a radius anywhere from a radius slightly larger than the disk up to a radius from the center point 26 of the disk 16 out to a hole 78 at the farthest corner of the sheet 12 can be drawn.

A circle having a radius less than the radius of the disk 16 is drawn by placing the device 10 over the center point of the circle to be drawn by lining up the hole 74 at the center point 26 of the disk 16 with the new center point, or by aligning the center point indicia 76 with the new center point. The sheet or plate 12 is then held down against the surface upon which the circle is to be drawn and the disk 16 is rotated about its center point 26 until a preselected radius point is visible beneath one of the holes 24 provided in the disk 16. The holes 24 are spaced from the center point 26 of the disk 16 at given specific intervals.

When the proper one of the holes 24 is selected, a pencil point or other suitable writing instrument is inserted into that hole 24 so that it will contact the surface below the sheet 12 on which the circle is to be drawn. With the sheet 12 firmly held in place, the disk 16 is then rotated about its center point 26 by moving the pencil or other writing instrument thereby inscribing a circle on the surface below the sheet 12. In this manner, a circle having a radius anywhere from a first small radius up to a radius approximately the same as the radius of the disk can be drawn.

Thus, by using a combination of the two above techniques, any number of circles can be drawn having radii from a first small radius up to a radius from the center point 26 of the disk 16 out to a hole 78 at the farthest corner of the sheet 12. The diameter of the largest circle is therefore much greater than the length of the device 12. Thus the compact device 10, which has no sharp points which could be injurious to the user, can be used to inscribe a circle having a diameter greater than the length of the device.

The measurement indicia 22 on the linear edge 20 can be used to determine the proper radius point to be used in drawing a circle of a preselected size. This radius point can then be used in the manner described above. The device 10 may be formed of a transparent plastic material to aid in the selection of the proper hole 18 or 24 to be used to draw the selected sized circle.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A device for drawing circles comprising;

a sheet-form member having a planar upper surface and a planar lower surface, a circular hole formed in said sheet form member and having a given diameter, alternating upper and lower lips positioned around the circumference of said hole, said lower lips projecting radially inwardly and having a bottom wall coplanar with said lower surface of said sheet-form member, a top surface below said upper surface of said sheet form member, and terminating in an inner circumferential wall, said upper lips having a lower surface elevated above said upper surface of said sheet form member and a top surface which slopes downwardly and radially inwardly to terminate in an inner circumferential wall, a circular disk having a diameter less than said diameter of said hole and greater than the diameter of said inner circumferential walls of said upper and lower lips, said disk having a flange formed at the circumference of said disk having a top surface coplanar with a top surface of said disk and a bottom surface at an elevation above a bottom surface of said disk said disk and said sheet-form member having a series of spaced holes therein to accommodate a marking point and being spaced at selected specific calibrated intervals, whereby said disk can be inserted into said hole in said sheet-form member and will be rotatably retained therein by said upper and lower lips.

2. The device of claim 1, wherein said disk is selectively axially movable within said hole such that said bottom surface of said disk can be positioned above or below said lower surface of said sheet-form member.

3. A device for drawing circles comprising:

a flat plate having a planar upper surface and a planar lower surface, a circular hole formed in said plate having a given diameter, a circular disk having upper and lower surfaces with a flange formed at the circumference of the upper surface, said flange being thinner than said disk, and having a diameter less than said diameter of said hole, retaining means comprising alternating upper and lower lips positioned around the circumference of said hole for rotatably retaining said disk by said flange within said hole and permitting said disk to float within said hole such that the lower surface of said disk can be selectively positioned above or below said lower surface of said plate, said disk and said plate having a series of spaced holes therethrough to accommodate a marking point and being spaced at selected specific calibrated intervals.

4. The device of claim 3, wherein said upper lip is comprised of a plurality of arc segments attached to said plate by means of a resilient support permitting said disk to be inserted into said hole.

5. In combination:

a flat plate, a circular hole formed in said plate having a given diameter, a circular disk with a flange formed at the circumference of an upper surface thereof, said flange being thinner than said disk and having a diameter less than said diameter of said hole, resilient retaining means comprising alternating upper and lower lips positioned around the circumference of said hole to rotatably retain said disk by said flange within said hole permitting said disk to float within said hole, said disk and said plate having a series of spaced holes therethrough to accommodate a marking point and being spaced at selected specific calibrated intervals.

6. The device of claim 5, wherein said disk is selectively axially movable within said hole.

* * * * *